United States Patent [19]

Buehning

[11] Patent Number: 4,936,934

[45] Date of Patent: Jun. 26, 1990

[54] PROCESS AND APPARATUS FOR COLLECTING NONWOVEN WEB

[75] Inventor: Peter G. Buehning, Short Hills, N.J.

[73] Assignee: Accurate Products Co., Hillside, N.J.

[21] Appl. No.: 229,268

[22] Filed: Aug. 8, 1988

[51] Int. Cl.[5] ..... D04H 3/16

[52] U.S. Cl. ..... 156/167; 19/308; 156/181; 156/285; 156/441; 264/555; 264/571; 425/83.1; 425/388

[58] Field of Search ..... 156/167, 181, 285, 441; 264/555, 571, DIG. 75, DIG. 78; 425/80.1, 83.1, 388; 19/148, 296, 299, 304, 307, 308

[56] References Cited

U.S. PATENT DOCUMENTS

| | | | |
|---|---|---|---|
| 304,527 | 9/1884 | Jarrell | 19/308 |
| 1,058,812 | 4/1913 | Topf | 19/308 |
| 2,990,004 | 6/1961 | Sowers et al. | 19/308 |
| 3,483,051 | 12/1969 | Mesek et al. | 19/308 |
| 3,509,009 | 4/1970 | Hartmann | 156/181 |
| 3,849,241 | 11/1974 | Butin et al. | 156/167 |
| 3,878,014 | 4/1975 | Melead | 156/285 |
| 4,666,647 | 5/1987 | Enloe et al. | 19/308 |

FOREIGN PATENT DOCUMENTS

| | | | |
|---|---|---|---|
| 1010146 | 11/1965 | United Kingdom | 19/308 |

*Primary Examiner*—Merrell C. Cashion, Jr.
*Assistant Examiner*—Steven D. Maki
*Attorney, Agent, or Firm*—R. L. Graham

[57] ABSTRACT

A meltblowing collector screen includes a vacuum pump and internal partitions for achieving substantially uniform air flow through the length of the screen thereby producing a web of uniform thickness.

10 Claims, 4 Drawing Sheets

PROCESS AND APPARATUS FOR COLLECTING NONWOVEN WEB

FIELD OF THE INVENTION

This invention relates generally to nonwoven webs and more particularly to a method and apparatus for collecting the webs as they are formed. In a preferred aspect, the invention relates to a rotary vacuum screen for collecting melt blown nonwoven webs.

BACKGROUND OF THE INVENTION

Processes and apparatus for preparing meltblown nonwoven webs from thermoplastic fibers have been described in publications such as Naval Research Laboratory Report No. 11437, submitted, Apr. 15, 1954; Naval Research Laboratory Report No. 5265, dated Feb. 11, 1979, and in a multitude of patents including U.S. Pat. Nos. 3,775,527, 3,825,379, 3,878,014, 3,849,241, and 3,978,185, to name but a few. In the melt blowing process, a molten polymer is extruded through a row of small orifices forming a row of fibers which are attenuated by convergent hot air streams on either side of the fiber row. The fibers are collected on a moving collector screen forming a web thereon. The equipment for carrying out the melt blowing process comprises an extruder, a die, air flow means, a collector screen, a windup drum, as well as ancillary components such as blowers, air heaters, and controls. The collector screen, as disclosed in U.S. Pat. Nos. 3,825,379 and 3,878,014, is frequently in the form of a rotating screen which collects the web on the surface and permits passage of air into the interior thereof.

The fibers must be evenly deposited on the collector screen to produce a uniform, high quality nonwoven web. One prior art approach for improving the web uniformity involves applying vacuum to the interior of the screen drum to increase the flow of air through the screen. Although the vacuum collector systems have been adequate for some applications, there remains a need for further improvement to produce high quality uniform webs, particularly for webs used as filters.

SUMMARY OF THE INVENTION

In its broadest form, the collector screen assembly of the present invention comprises (a) an inner stationary drum having a horizontal slot formed therein for passage of air from the exterior to the interior of the drum;

(b) a rotating drum mounted concentrically on the stationary drum and having a screen substantially covering the outer surface of the stationary drum;

(c) means for applying a vacuum to the interior of the stationary drum; and (d) partitions positioned transversely within the stationary drum including outlet conduits to provide for a predetermined air flow distribution through the air inlet slot.

In a preferred embodiment, the partitions divide the stationary drum into a plurality of side-by-side compartments, each compartment having an inlet through a longitudinal portion of the air slot, and an outlet to the exterior of the drum. The compartment inlets and compartment outlets, respectively, are approximately of the same cross sectional area so that the air flow rate through each compartment is approximately the same for a given differential pressure.

In another embodiment of the invention, the compartment inlets and outlets are sized to provide a controlled nonuniform flow along the air inlet slot. For example, it may be desirable to have a web with a thicker transverse midsection and thinner edge sections. This may be achieved by sizing the compartment inlets and/or outlets to provide a controlled larger air flow rate in the midsection and lower air flow rates in the flanking edge sections.

The number of partitions, and hence the number of compartments, will depend on the length of the drum. Generally, the partitions should be spaced 4 to 12 inches apart along the drum axis. Six to 12 compartments will be satisfactory for most drums.

The process of the present invention comprises extruding a molten thermoplastic resin to form a plurality of side-by-side fibers; blowing high-velocity, hot gas streams onto opposite sides of the fibers to attenuate and draw down the fibers; and collecting the fibers as a web on a rotating screen as the gas passes through the screen. The improvement according to the present invention comprises controlling the air flow into the screen along the length of the screen to provide a predetermined transverse web thickness profile.

In a preferred embodiment, the controlled air flow through the screen is generally uniform along the length of the screen to produce a web of uniform thickness.

DESCRIPTION OF THE PREFERRED EMBODIMENTS

Figure 1:
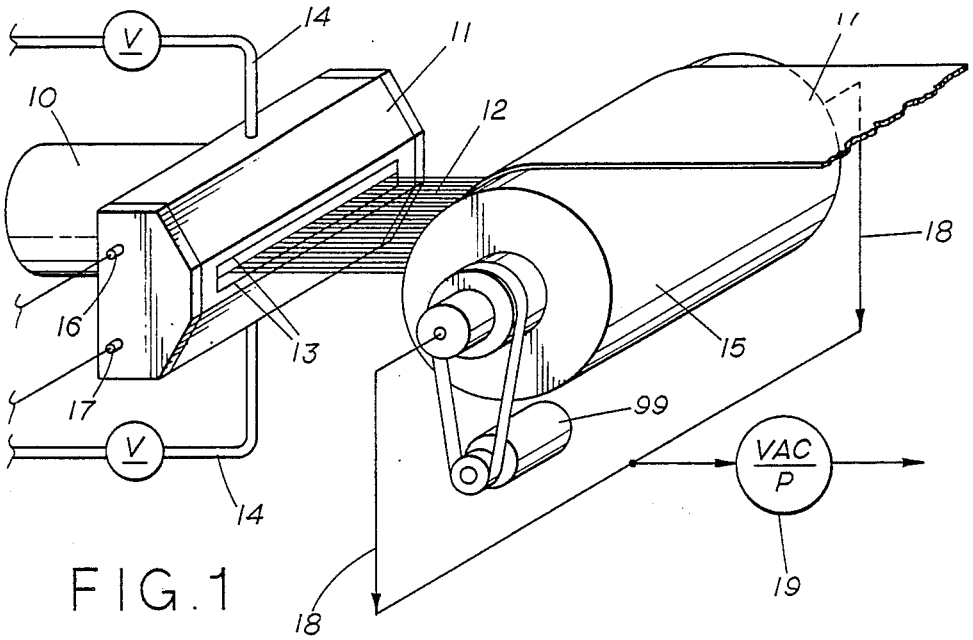
FIG. 1 is a simplified and schematic perspective view showing the major components of a melt blowing apparatus, including collector screen of the present invention.

As shown in FIG. 1, the melt blowing apparatus comprises an extruder 10 for delivering molten resin to a melt blowing die 11 which extrudes a series of side-by-side fibers 12 into converging hot air streams discharging from air slots 13, and a collector drum or screen 15. The melt blowing apparatus also includes compressor and air furnace (not shown) for delivering hot air through pipes 14 to the die. The die is provided with heating elements 16 and 17 for heating the resin and the air. The hot air is conducted through passages formed in the die and discharged as converging sheets of air through slots 13 onto opposite sides of the fibers 12. The molten fibers are stretched and blown onto collector screen assembly 15 forming a nonwoven web 17 which is withdrawn by a take up roller (not shown). As will be described in more detail below, the collector screen assembly 15 has a rotating outer screen which permits the collection of the fibers and formation of web 17 as air passes through the screen and exits through manifold 18. Blower 19 creates a vacuum in manifold 18 and within collector screen assembly 15.

The extruder, die, and air facilities mentioned above may be generally as described in U.S. Pat. No. 3,978,185, the disclosure of which is incorporated herein by reference. The polymers used in melt blowing apparatus, by way of example, includes polypropylene, low and high density polyethylene, ethylene copolymers (e.g. EVA), nylon, polyamides, polyesters, polystyrene, poly-4-methylpentenes-1, polymethylmethacrylate, polytrifluorochloro ethylene, polyurethanes, polycarbonates, silicones, pitch and blends of the above resins and any other resins used in meltblowing.

Figure 2:
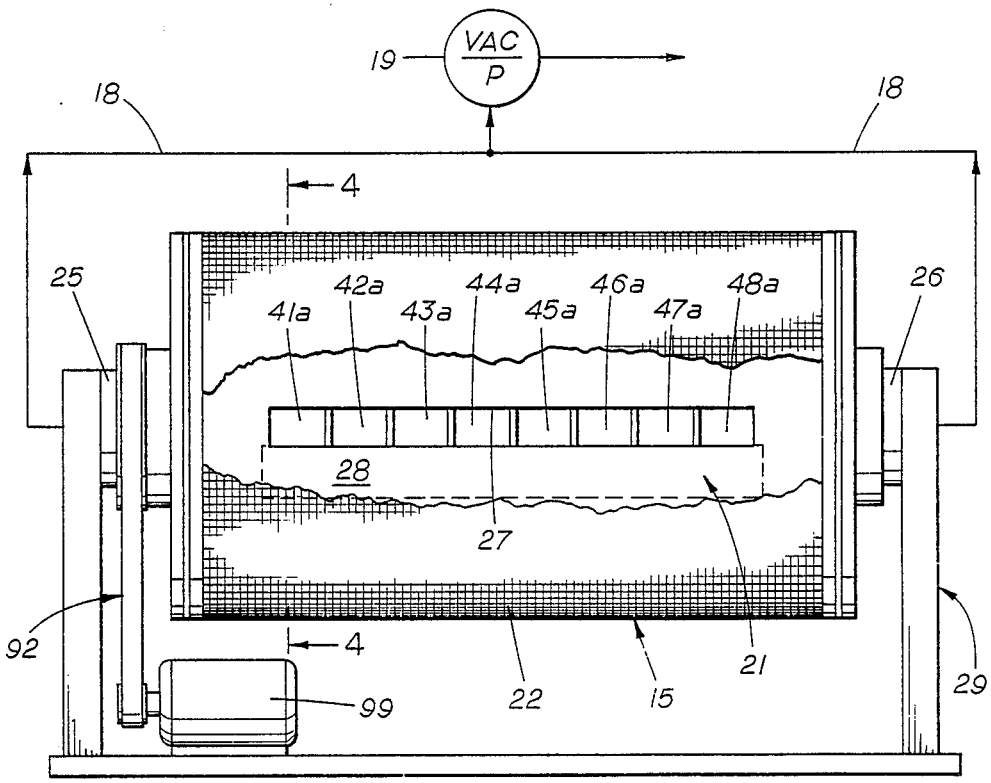
FIG. 2 is a side elevation of the collector screen, shown with portions cut away.
Figure 3:
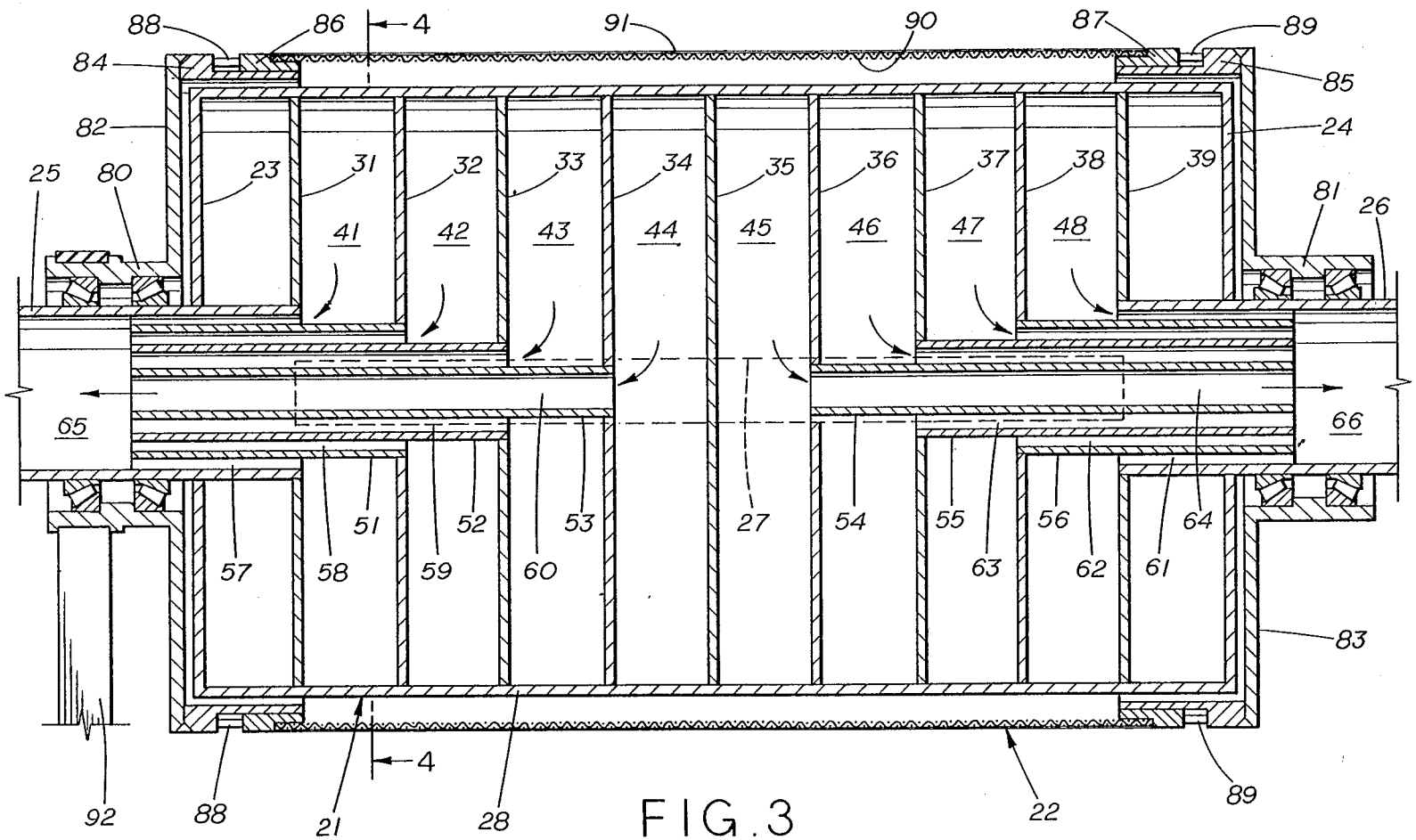
FIG. 3 is a longitudinal cross sectional view of the collector screen shown in FIG. 2.
Figure 4:
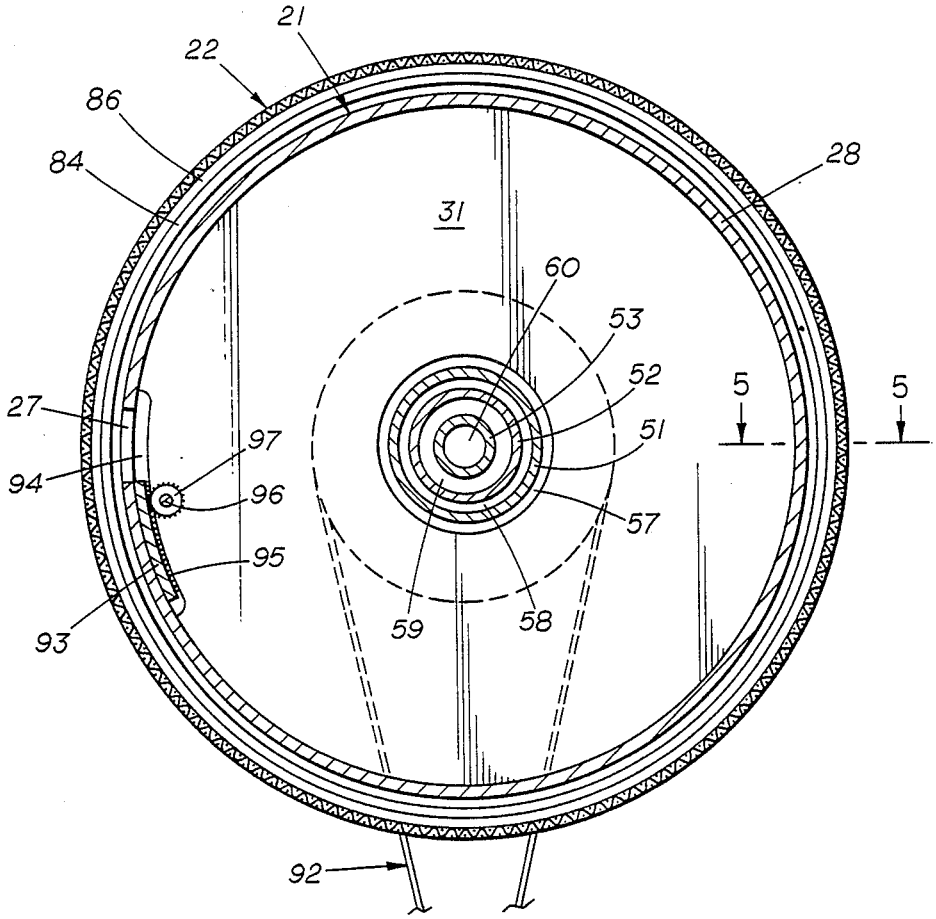
FIG. 4 is a a transverse sectional view of the collector screen, with the cutting plane taken along line 4—4 of FIG. 3.

A novel feature of the present invention resides in the construction and operation of the screen assembly 15. Referring to FIGS. 2, 3, and 4 the assembly 15 is seen to include two main relatively rotating members: an inner stationary drum 21 and outer rotating screen 22.

The inner stationary drum 21 comprises circular end panels panels 23 and 24 and a cylindrical metal shell 28 which is secured to the outer periphery of end panel 23 and 24 thereby forming a hollow drum. An elongate slot 27 (best seen in FIG. 2) is formed in shell 28 and extends parallel to the axis of the drum 21. The slot 27 extends substantially the entire width of the fiber collection area (described below) and provides an inlet for flow of air into the interior of shell 28. The width of the slot 27 may vary within a wide range depending in part on the size of the die 11 and the diameter of the drum 21. Generally, the slot width will be between 3 to 12 inches, with 4 to 8 inches being preferred. Also, as described below, the preferred slot width is adjustable.

Pipe stubs 25 and 26 secured to panels 23 and 24 extend outwardly therefrom in opposite directions and are mounted on frame 29 as illustrated in FIG. 2. The pipe mounts may be conventional trunion connections permitting angular adjustment of the drum 21 and the position of slot 27.

Mounted in the interior of drum 21 are a plurality of axially spaced circular partitions 31 through 39 which divide the interior of drum 21 into side-by-side compartments 41 through 48. Each of the partitions, except middle partition 35 has a central opening permitting flow of air therethrough. Partition 35 is solid, dividing the drum 21 into two equal longitudinal halves. As best seen in FIG. 2, the partitions divide the air slot 27 into separate inlets, one for each compartment, illustrated as 41*a* through 48*a*. Preferably, the compartment inlets 41*a* through 48*a* have approximately the same cross sectional flow area.

As shown in FIG. 3, each compartment has a pipe member extending axially from its outer most partition to a position outside drum 21. For example, pipe stubs 25 and 26 extend axially in opposite directions and provide outlet conduits for compartments 41 and 48, respectively. In a similar construction, conduits 51, 52, and 53 provide outlets for compartments 42, 43, and 44; and pipe members 54, 55, and 56 provide outlets for compartments 45, 46, and 47. Each pipe member conducts air from its compartment to pipe stubs 25 or 26 outside the drum 21. The openings in the partitions are sized to fit its associated pipe member.

The pipe members for each half of the drum 21 are concentrically arranged and terminate outside the interior of the drum 21 where the air intermixes in header zones 65 and 66. The fabrication of the panels, partitions, shell and pipe members may be of welded steel construction. This provides rigidity for maintaining the concentric relationship of the pipe members.

The air outlet conduit for each compartment in one half of the drum 21 is as follows: annular conduit 57 for compartment 41, annular conduit 58 for compartment 42, annular conduit 59 for compartment 43, and conduit 60 for compartment 44. The other longitudinal half of the drum 21, likewise is provided with conduits 61, 62, 63, and 64 for compartments 48, 47, 46, and 45, respectively. For uniformly distributed air flow through slot 27, the flow areas of inlets 41*a* through 48*a* are approximately the same, and flow areas of outlets 57 through 64 are approximately the same.

Air passes through drum 21 by flowing through the slot inlets (e.g. 41*a*) into drum compartment (e.g. 41), through outlet conduits (e.g. 57), to header zone 65 outside the drum where the air from the compartments (e.g. compartments 41, 42, 43, and 44) is combined and piped through the vacuum manifold system 18. Where the inlet and outlet of each compartment are approximately the same size (i.e. flow area) as the inlets and outlets of the other compartments, the flow rate (and average flow velocity) through the flow inlets will be approximately the same for a given vacuum applied to pipe members 25 and 26. This provides for generally uniform flow rates across the length of slot 27. This, in turn, produces a web of generally uniform thickness.

Figure 6:
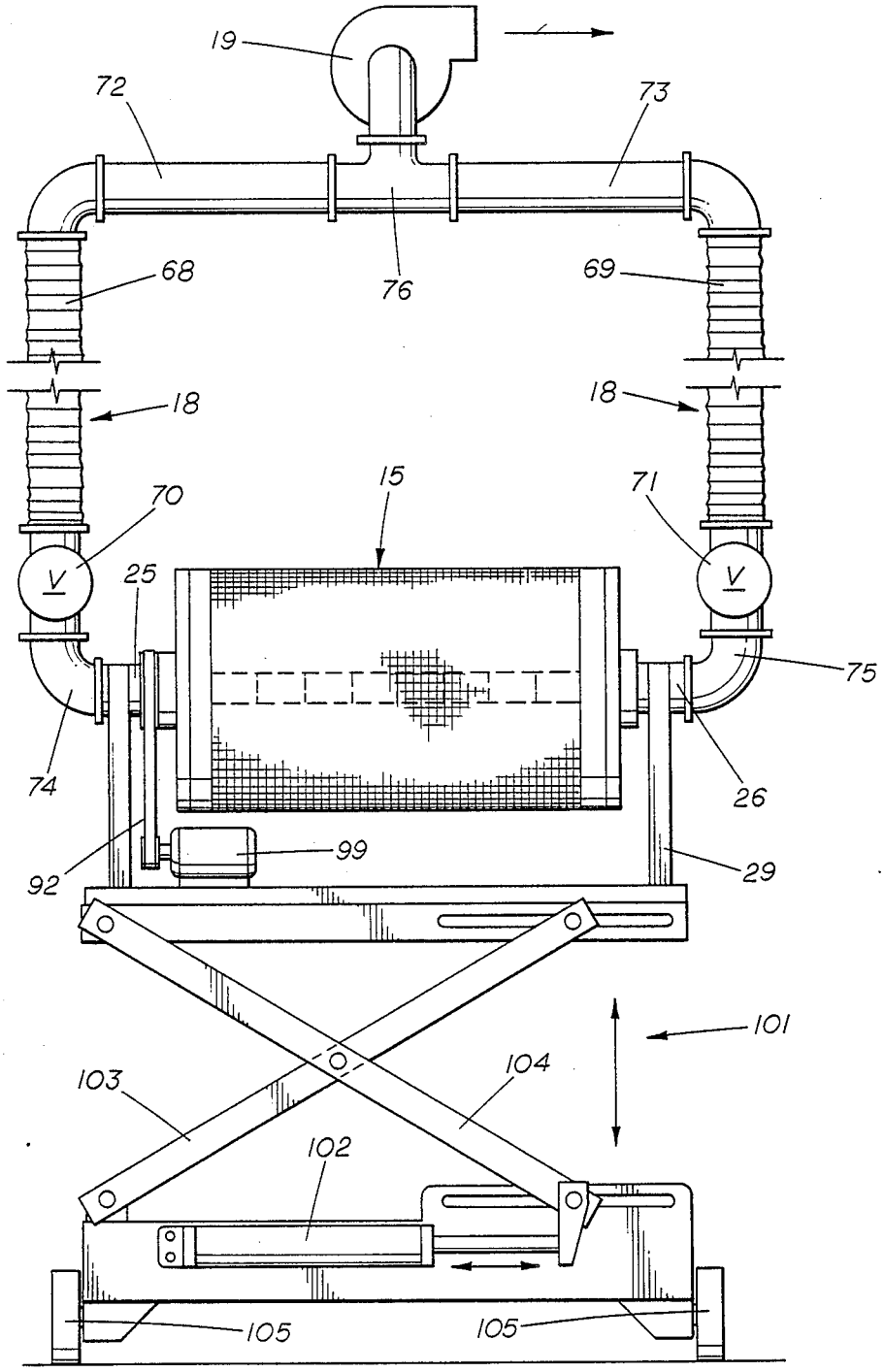
FIG. 6 is a side elevation of the collector screen assembly.

As illustrated in FIG. 6, the outer ends of pipe members 25 and 26 are connected to a vacuum pump 19 through manifold assembly 18 which includes flexible hoses 68 and 69, valves 70 and 71, pipes 72 and 73, and fittings 74, 75, and 76. The symmetry of the manifold ensures even air flow from each end of the drum 21. Fittings 74 and 75 should be attached to pipe stubs 25 and 26 in such a manner to permit angular adjustment of drum 21 on the support frame 29. The assembly above the flexible hoses 68 and 69 are mounted on a support separate from frame 29. Preferably the manifold and vacuum pump are disposed over the collector screen assembly 15.

Returning to FIG. 3, the collector screen 22 is in the form of a screen drum which is concentric to drum 21 and is journaled to pipe member 25 and 26 by mounting sleeves 80 and 81. Sleeves 80 and 81 are secured to circular end panels 82 and 83 which define the sides of the collector screen 22.

Figure 5:
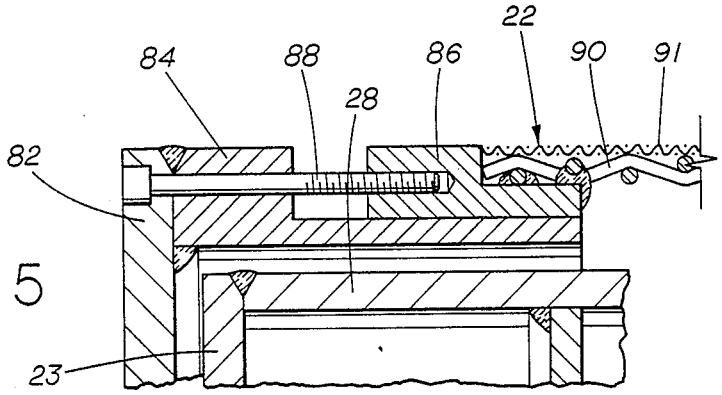
FIG. 5 is a cross sectional view of a peripheral portion of the collector screen, with the cutting plane taken along line 5—5 of FIG. 4.

Rims 84 and 85 extend inwardly from the outer edges of panels 82 and 83 respectively. The edges of a heavy duty screen 90 are welded or otherwise secured to the rims by couplings 86 and 87 which include bolts 88 and 89 for applying a tension to the screen. A fine mesh screen 91 sized to separate air from the fibers extends around the heavy duty screen and may be also secured by couplings 86 and 87 by welding. FIG. 5 illustrates details of the screen mounting assembly.

As best seen in FIG. 4, outer screen 22 is rotatively driven around stationary drum 21 by drive assembly 92 which may be in the form of a conventional belt or chain drive including motor 99. The screen drum 22 is normally rotated at a rate to provide a screen speed of between 2 to 300 fpm, preferably 10 to 200 fpm, most preferably 50 to 150 fpm.

A clearance of from 0.020 to 0.100 inches between the drums will permit free rotation. The screen should have a diameter of between about 10 to 40 inches.

In order to vary the width and hence the air flow rate through screen 91, the inner drum 21 may include a slot cover 93 illustrated in FIG. 4. The cover 93 extends substantially the full length of the slot 27 and has the same curvature as shell 28.

Suitable notched openings 94 in the outer edges of each partition are provided to permit movement of the cover 93 along the interior surface of shell 28. Strip gears, one shown as 95, are provided at spaced intervals on the inwardly facing side of cover 93. A rod 96 extends parallel to cover 93 and is provided with pinion gears 97 which mesh with strip gears 95. One end of rod 96 is journaled to panel 24 and the other end extends through panel 23 and may be provided with a socket to permit rotation of rod 96. A hole may be provided in panel 82 of the rotating screen 22 which aligns with the socket end of rod 96 thereby permitting insertion of a wrench for adjustment of cover 93. Turning of rod 96 clockwise as viewed in FIG. 4, causes gears 95 and 97 to move the cover 93 upward reducing the width of slot 27 or closing it completely. The gears and socket assembly may be such to lock the cover in its adjusted position.

In order to permit alignment of the collector screen assembly 15 in both horizontal (toward the die) and vertical directions, the support frame 29 is mounted on an adjustable assembly. The assembly, shown in FIG. 6, comprises a scissors elevator 101 on which the frame 29 is mounted. A hydraulic cylinder 102 moves the assembly arms 103 and 104 which raises or lowers the frame 29 with the collector 15 thereon. Note the flexible hoses 68 and 69 permit vertical movement. Horizontal movement is achieved by providing the elevator assembly 101 with wheels 105 and may include a screw drive assembly (not shown) for adjusting the distance of the screen 22 from the die 11.

The adjustable mounting assembly is extremely important when aligning large collector screens 15 with the melt blowing die 11. The following adjustments are normally required: (1) positioning the collector screen 15 at the proper horizontal position so that the slot 27 is aligned with the row of die orifices; (2) elevating the collector screen to bring the slot 27 into horizontal alignment with the die orifices; (3) adjusting angular position of drum 21 to place the slot 27 at the fiber collection area (i.e. The area on the screen at which the mixed fibers and air intercept the screen 91). Between the die exit and the screen 91, the stream flares out slightly in the vertical direction.

It is preferred that the angular position of the slot 27 be slightly in advance of the center-line of the fibers and air stream direction shown in FIG. 1. Preferably the horizontal center line of the slot 27 (midpoint of the slot width) is from 0 to 30°, preferably 5° to 15°, in advance of the horizontal center line of the air and fiber stream at the collector screen 91.

The present invention has been described with references to a collector for achieving a generally uniform thickness web by providing a uniform air flow through the slot. Variations of this embodiment include adjusting the air flow through the slot to achieve a predetermined web profile. This variation may be achieved by providing the slot inlets of different size to effect different flow rate and thereby producing a web of varying (but predetermined) thickness. Also individual slot covers for each compartment are possible. The generic concept embodied in the present invention is controlled flow through the slot to achieve a predetermined web thickness profile along the length of the slot.

What is claimed is:

1. A meltblowing process comprising extruding a row of molten fibers; blowing hot air onto both sides of the fibers; collecting the fibers on a rotating screen drum while air flows through the screen into the interior of the screen drum and axially out of the drum, the improvement wherein the air is flowed through the rotating screen into a stationary drum having an axis via a row of equally sized side-by-side air inlets formed in said stationary drum and underlying said screen, and axially withdrawn from the stationary drum on both sides of the drum through a plurality of pipes concentric with the axis of the drum, the pipes defining conduits of substantially the same cross sectional flow area, the conduits of one longitudinal half of the drum terminating at a location axially outside the end of the drum defining that half, and the conduits of the other longitudinal half of the drum terminating at a location outside the opposite end of the drum, whereby air flow rate through the side-by-side inlets is substantially equal.

2. The process of claim 1 wherein the stationary drum comprises from 4 to 12 air inlets.

3. The process of claim 1 wherein the drum comprises from 6 to 10 air inlets and 6 to 10 separate conduits.

4. The process of claim 1 wherein the row of air inlets of the stationary drum are aligned horizontally and extend parallel to the drum axis and are positioned angularly in advance of the center line of the fibers and air stream.

5. Apparatus for separating fibers and air produced from a meltblowing die which comprises (a) a stationary drum having an axis and having a slot formed therein, said slot being aligned with the meltblowing die to receive air therefrom;

(b) a central axially transverse partition dividing the interior of the drum into two equal drum halves;

(c) each drum half having (i) a plurality of transverse partitions dividing the drum half into substantially equal compartments and the slot into equal longitudinal side-by-side increments;

(ii) a plurality of pipes concentric with the axis of the drum, one pipe extending from each compartment in a direction away from the central partition and terminating in a header zone axially outside the drum, the pipes of each drum half being concentric and defining flow conduits from each compartment having substantially the same flow area;

(d) a rotating screen mounted on said stationary drum; and (e) means for applying a vacuum to said header zones to cause air to flow through the slot, through each compartment, through its conduit, and into the header zones.

6. The apparatus of claim 5 wherein the vacuum means includes an air blower aligned with the mid section of the length of the stationary drum, a manifold interconnecting the suction of the air blower to each header zone whereby the flow path of the air from each header zone to the blower is substantially identical.

7. The apparatus of claim 5 wherein the drum comprises from 4 to 12 axially aligned side-by-side compartments.

8. The apparatus of claim 5 wherein the drum comprises from 6 to 10 axially aligned side-by-side compartments.

9. The apparatus of claim 5 wherein the drum further comprises means for adjusting the width of the slot from between 0 to 100% open.

10. The apparatus of claim 5 and further comprising means to elevate and lower said stationary and rotating drum assembly.

* * * * *